US012616244B2

(12) United States Patent
Liu et al.

(10) Patent No.: US 12,616,244 B2
(45) Date of Patent: May 5, 2026

(54) ATOMIZER, ELECTRONIC ATOMIZATION DEVICE, AND LIQUID GUIDE MECHANISM

(71) Applicant: SHENZHEN SMOORE TECHNOLOGY LIMITED, Shenzhen (CN)

(72) Inventors: Chengchuan Liu, Shenzhen (CN); Guilin Lei, Shenzhen (CN); Boxue Gong, Shenzhen (CN); Ru Jiang, Shenzhen (CN); Shuai Luo, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 468 days.

(21) Appl. No.: 18/182,000

(22) Filed: Mar. 10, 2023

(65) Prior Publication Data

US 2023/0200443 A1 Jun. 29, 2023

Related U.S. Application Data

(63) Continuation of application No. PCT/CN2020/129455, filed on Nov. 17, 2020.

(30) Foreign Application Priority Data

Sep. 11, 2020 (WO) ..... PCT/CN2020/114889

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/42* (2020.01); *A24F 40/46* (2020.01); *A24F 40/485* (2020.01)

(58) Field of Classification Search
CPC ..... A24F 40/40; A24F 40/44
See application file for complete search history.

(56) References Cited

U.S. PATENT DOCUMENTS 10,524,518 B1 1/2020 Tygett
11,058,151 B2 * 7/2021 Biel ..... A24F 15/015
(Continued)

FOREIGN PATENT DOCUMENTS

CN 106820272 A 6/2017
CN 207100509 U 3/2018
(Continued)

OTHER PUBLICATIONS

European Patent Office, Search Report in European Patent Application No. 20953087.2 (Feb. 12, 2024).
(Continued)

*Primary Examiner* — Russell E Sparks
(74) *Attorney, Agent, or Firm* — Leydig, Voit & Mayer, Ltd.

(57) ABSTRACT

A vaporizer includes: a bottom plate having a first surface and a second surface arranged oppositely; a vaporization base arranged on and covering the first surface of the bottom plate and cooperating with the first surface of the bottom plate to form a vaporization cavity; a vaporization core accommodated in the vaporization cavity, the vaporization core heating and vaporizing liquid in the vaporization cavity when energized; and a liquid guiding assembly for absorbing liquid on the bottom plate, the liquid guiding assembly including: a first liquid guiding portion arranged on the first surface of the bottom plate and cooperating with the first surface of the bottom plate to form at least one first liquid guiding channel; and a second liquid guiding portion including at least one second liquid guiding channel, one end of the
(Continued)

second liquid guiding channel being in communication with the first liquid guiding channel.

24 Claims, 12 Drawing Sheets

(51) Int. Cl.

| | |
|---|---|
| ***A24F 40/42*** | (2020.01) |
| ***A24F 40/46*** | (2020.01) |
| ***A24F 40/485*** | (2020.01) |

(56) References Cited

U.S. PATENT DOCUMENTS

| | | | | |
|---|---|---|---|---|
| 2015/0027470 | A1 | 1/2015 | Kane et al. | |
| 2018/0343922 | A1 | 12/2018 | Stadler et al. | |
| 2020/0000151 | A1 | 1/2020 | Fraser et al. | |
| 2020/0060343 | A1 | 2/2020 | Tan et al. | |
| 2020/0094000 | A1 | 3/2020 | Peng | |
| 2020/0107585 | A1 | 4/2020 | Atkins et al. | |
| 2020/0275696 | A1 | 9/2020 | Atkins et al. | |
| 2021/0106061 | A1 | 4/2021 | Wang et al. | |
| 2021/0120874 | A1 | 4/2021 | Tong | |
| 2022/0000181 | A1* | 1/2022 | Qiu | A24F 40/10 |
| 2022/0248756 | A1 | 8/2022 | Chen | |
| 2023/0063069 | A1 | 3/2023 | Lei et al. | |
| 2023/0114975 | A1 | 4/2023 | Matsuda et al. | |

FOREIGN PATENT DOCUMENTS

| | | | |
|---|---|---|---|
| CN | 108135258 | A | 6/2018 |
| CN | 109007980 | A | 12/2018 |
| CN | 208837093 | U | 5/2019 |
| CN | 110250576 | A | 9/2019 |
| CN | 209376699 | U | 9/2019 |
| CN | 110313647 | A | 10/2019 |
| CN | 110613171 | A | 12/2019 |
| CN | 110613172 | A | 12/2019 |
| CN | 209711528 | U | 12/2019 |
| CN | 209825214 | U | 12/2019 |
| CN | 110638101 | A | 1/2020 |
| CN | 110638102 | A | 1/2020 |
| CN | 210158026 | U | 3/2020 |
| CN | 210203316 | U | 3/2020 |
| CN | 111011932 | A | 4/2020 |
| CN | 111011933 | A | 4/2020 |
| CN | 111134366 | A | 5/2020 |
| CN | 210611014 | U | 5/2020 |
| CN | 111329115 | A | 6/2020 |
| CN | 211020994 | U | 7/2020 |
| CN | 211091889 | U | 7/2020 |
| CN | 214594168 | U | 11/2021 |
| CN | 214629849 | U | 11/2021 |
| CN | 214710337 | U | 11/2021 |
| CN | 114158778 | A | 3/2022 |
| EP | 3287017 | A1 | 2/2018 |
| FR | 3087318 | A1 | 4/2020 |
| WO | 2015157224 | A1 | 10/2015 |
| WO | 2017139963 | A1 | 8/2017 |
| WO | 2018161254 | A1 | 9/2018 |
| WO | 2019211311 | A1 | 11/2019 |
| WO | 2020064921 | A1 | 4/2020 |
| WO | 2020081849 | A2 | 4/2020 |
| WO | 2020169957 | A1 | 8/2020 |

OTHER PUBLICATIONS

Patent Cooperation Treaty, International Search Report and Written Opinion, International Application No. PCT/CN2020/129455 (Jun. 15, 2021).

Patent Cooperation Treaty, International Search Report and Written Opinion, International Application No. PCT/CN2020/114889 (May 28, 2021).

Patent Cooperation Treaty, International Search Report and Written Opinion, International Application No. PCT/CN2020/128817 (Feb. 19, 2021).

U.S. Patent and Trademark Office, Advisory Action in U.S. Appl. No. 17/983,260 (Aug. 12, 2025).

U.S. Patent and Trademark Office, Office Action in U.S. Appl. No. 17/983,260 (Jun. 4, 2025).

Chinese Patent Office, Notification of grant of patent right for invention in Chinese Patent Application No. 202010955460.5 (May 30, 2025).

U.S. Patent and Trademark Office, Office Action in U.S. Appl. No. 18/181,955 (Aug. 19, 2025).

Chinese Patent Office, Office Action in Chinese Patent Application No. 202011287078.8 (Sep. 25, 2024).

Chinese Patent Office, Office Action in Chinese Patent Application No. 202011270990.2 (Oct. 23, 2024).

European Patent Office, Search Report in European Patent Application No. 20935684.9 (Sep. 22, 2023).

European Patent Office, Search Report in European Patent Application No. 20952851.2 (Oct. 12, 2023).

Chinese Patent Office, Notification of grant of patent right for invention in Chinese Patent Application No. 202011287078.8 (Jan. 14, 2025).

Chinese Patent Office, Notification of grant of patent right for invention in Chinese Patent Application No. 202011270990.2 (Jan. 16, 2025).

Chinese Patent Office, Office Action in Chinese Patent Application No. 202010955460.5 (Jan. 16, 2025).

U.S. Patent and Trademark Office, Office Action in U.S. Appl. No. 17/983,260 (Feb. 21, 2025).

European Patent Office, Intention to grant in European Patent Application No. 20953087.2 (Feb. 17, 2025).

U.S. Patent and Trademark Office, Office Action in U.S. Appl. No. 17/983,260 (Oct. 10, 2025).

U.S. Patent and Trademark Office, Office Action in U.S. Appl. No. 18/181,955 (Nov. 14, 2025).

European Patent Office, Office Action in European Patent Application No. 20952851.2 (Oct. 8, 2025).

* cited by examiner

ATOMIZER, ELECTRONIC ATOMIZATION DEVICE, AND LIQUID GUIDE MECHANISM

CROSS-REFERENCE TO PRIOR APPLICATION

This application is a continuation of International Patent Application No. PCT/CN2020/129455, filed on Nov. 17, 2020, which claims priority to International Patent Application No. PCT/CN2020/114889, filed on Sep. 11, 2020. The entire disclosure of both applications is hereby incorporated by reference herein.

FIELD

The present invention relates to the technical field of electronic vaporization devices, and in particular, to a vaporizer, an electronic vaporization device, and a liquid guiding mechanism.

BACKGROUND

A vaporizer is a device that vaporizes liquid (such as e-liquid) into gases or tiny particles, and is widely used in apparatuses such as medical equipment, or an e-cigarette.

Currently, the vaporizer generally includes a bottom plate, a vaporization base, and a vaporization core. The vaporization base is arranged on and covers the bottom plate and cooperates with the bottom plate to form a vaporization cavity. The vaporization core is accommodated in the vaporization cavity for heating and vaporizing the liquid in the vaporization cavity when energized. Specifically, air inlet holes are also provided on the bottom plate, and one end of each air inlet hole is in communication with external air, and the other end is in communication with the vaporizer, so that the external air can enter the vaporization cavity through the air inlet holes.

However, a large amount of liquid will accumulate on a side surface of the bottom plate facing the vaporization base during use of an existing vaporizer, and will leak out through the air inlet holes of the bottom plate, resulting in liquid leakage.

SUMMARY

In an embodiment, the present invention provides a vaporizer, comprising: a bottom plate comprising a first surface and a second surface arranged oppositely; a vaporization base arranged on and covering the first surface of the bottom plate and cooperating with the first surface of the bottom plate to form a vaporization cavity; a vaporization core accommodated in the vaporization cavity, the vaporization core being configured to heat and vaporize liquid in the vaporization cavity when energized; and a liquid guiding assembly configured to absorb liquid on the bottom plate, the liquid guiding assembly comprising: a first liquid guiding portion arranged on the first surface of the bottom plate and cooperating with the first surface of the bottom plate to form at least one first liquid guiding channel; and a second liquid guiding portion comprising at least one second liquid guiding channel, one end of the second liquid guiding channel being in communication with the first liquid guiding channel, wherein a horizontal size of the first liquid guiding channel decreases gradually in a direction toward the second liquid guiding portion, and wherein a capillary force of the second liquid guiding channel is greater than a capillary force of the first liquid guiding channel such that liquid absorbed by the first liquid guiding portion by the capillary force of the first liquid guiding channel is guidable to the second liquid guiding portion.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
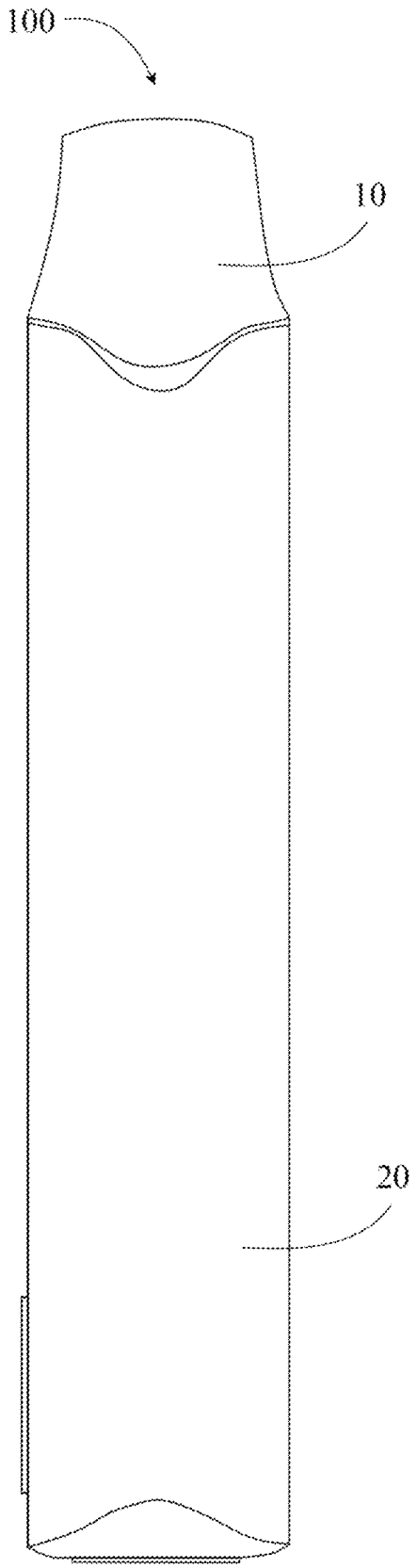
FIG. 1 is a schematic structural diagram of an electronic vaporization device according to an embodiment of this application.

In an embodiment, the present invention provides a vaporizer, an electronic vaporization device, and a liquid guiding mechanism. The vaporizer can resolve a problem that a large amount of liquid will accumulate on a side surface of a bottom plate facing a vaporization base during use of an existing vaporizer, and will leak out from air inlet holes of the bottom plate, resulting in liquid leakage.

In an embodiment, the present invention provides a vaporizer. The vaporizer includes a bottom plate, a vaporization base, a vaporization core, and a liquid guiding assembly. The bottom plate includes a first surface and a second surface that are arranged oppositely. The vaporization base is arranged on and covers the first surface of the bottom plate and cooperates with the first surface of the bottom plate to form a vaporization cavity. The vaporization core is accommodated in the vaporization cavity for heating and vaporizing liquid in the vaporization cavity when energized. The liquid guiding assembly is configured to absorb liquid on the bottom plate, where the liquid guiding assembly includes a first liquid guiding portion and a second liquid guiding portion. The first liquid guiding portion is arranged on the first surface of the bottom plate and cooperates with the first surface of the bottom plate to form at least one first liquid guiding channel; and the second liquid guiding portion includes at least one second liquid guiding channel, and one end of the second liquid guiding channel is in communication with the first liquid guiding channel. A horizontal size of the first liquid guiding channel decreases gradually in a direction toward the second liquid guiding portion, and a capillary force of the second liquid guiding channel is greater than that of the first liquid guiding channel, for liquid absorbed by the first liquid guiding portion by the capillary force of the first liquid guiding channel to be guided to the second liquid guiding portion.

In an embodiment, the present invention provides an electronic vaporization device. The electronic vaporization device includes a vaporizer and a power supply component, where the vaporizer is the vaporizer mentioned above and is configured to heat and vaporize liquid when energized, and the power supply component is connected with the vaporizer and is configured to supply power to the vaporizer.

In an embodiment, the present invention provides a liquid guiding mechanism. The liquid guiding mechanism includes a base and a liquid guiding assembly. The base includes a first surface and a second surface arranged oppositely. The liquid guiding assembly is configured to absorb liquid on the base, where the liquid guiding assembly includes a first liquid guiding portion and a second liquid guiding portion. The first liquid guiding portion is arranged on the first surface of the base and cooperates with the base to form at least one first liquid guiding channel; and the second liquid guiding portion includes at least one second liquid guiding channel, and one end of the second liquid guiding channel is in communication with the first liquid guiding channel, where a horizontal size of the first liquid guiding channel decreases gradually in a direction toward the second liquid guiding portion, and a capillary force of the second liquid guiding channel is greater than a capillary force of the first guiding channel, to guide liquid absorbed by the first liquid guiding portion by the capillary force of the first liquid guiding channel to the second liquid guiding portion.

This application provides a vaporizer, an electronic vaporization device, and a liquid guiding mechanism. According to the vaporizer, by arranging the bottom plate and arranging the first liquid guiding portion on the first surface of the bottom plate, the first liquid guiding portion cooperates with the first surface of the bottom plate to form at least one first liquid guiding channel. Meanwhile, the second liquid guiding portion is arranged on the first surface of the bottom plate, at least one second liquid guiding channel is formed on the second liquid guiding portion, one end of the second liquid guiding channel is in communication with the first liquid guiding channel, and the horizontal size of the first liquid guiding channel gradually decreases in the direction toward the second liquid guiding portion. In this way, the capillary force of the first liquid guiding channel increases gradually in the direction toward the second liquid guiding portion, and the gradually increasing capillary force is used to absorb and guide the liquid on the first surface of the bottom plate. Meanwhile, the capillary force of the second liquid guiding channel is greater than the capillary force of the first liquid guiding channel, so that the liquid absorbed by the first liquid guiding portion by the capillary force of the first liquid guiding channel is guided to the second liquid guiding portion. Therefore, the liquid on the bottom plate is stored to greatly reduce the probability of liquid leakage of the vaporizer.

The following clearly and completely describes the technical solutions in embodiments of this application with reference to the accompanying drawings in the embodiments of this application. Apparently, the described embodiments are merely some but not all of the embodiments of this application. All other embodiments obtained by a person of ordinary skill in the art based on the embodiments of this application without creative efforts fall within the protection scope of this application.

The terms "first", "second", and "third" in this application are used for descriptive purposes only and should not be construed as indicating or implying relative importance or implicitly indicating the number of technical features indicated. Therefore, a feature defined by "first", "second", or "third" may explicitly indicate or implicitly include at least one of the features. In the description of this application, unless otherwise specifically defined, "a plurality of" means at least two, for example, two or three. All directional indications (for example, up, down, left, right, front, back . . . ) in the embodiments of this application are only used for explaining relative position relationships, movement situations, or the like between various components in a specific posture (as shown in the accompanying drawings). If the specific posture changes, the directional indications change accordingly. In addition, the terms "comprise", "have", and any variants thereof are intended to cover non-exclusive inclusion. For example, a process, method, system, product, or device that includes a series of steps or units is not limited to the listed steps or units; and instead, further optionally includes a step or unit that is not listed, or further optionally includes another step or unit that is intrinsic to the process, method, product, or device.

"Embodiment" mentioned in the specification means that specific features, structures, or characteristics described with reference to the embodiment may be included in at least one embodiment of this application. The term appearing at different positions of the specification may not refer to the same embodiment or an independent or alternative embodiment that is mutually exclusive with another embodiment. A person skilled in the art explicitly or implicitly understands that the embodiments described in the specification may be combined with other embodiments.

The following describes this application in detail with reference to the accompanying drawings and embodiments.

FIG. 1 is a schematic structural diagram of an electronic vaporization device according to an embodiment of this application. In this embodiment, an electronic vaporization device 100 is provided. The electronic vaporization device 100 may be configured to heat and vaporize cigarette liquid to form vapor for a user to inhale, where the electronic vaporization device 100 may specifically be an e-cigarette, and the cigarette liquid may specifically be e-liquid.

Specifically, the electronic vaporization device 100 includes a vaporizer 10 and a main unit 20. The vaporizer 10 and the main unit 20 are connected in a detachable manner. The vaporizer 10 is configured to heat and vaporize the cigarette liquid when energized. A power supply component is arranged in the main unit 20, and the vaporizer 10 is inserted into a port on one end of the main unit 20 and is connected with the power supply component in the main unit 20, so that the power supply component supplies power to the vaporizer 10. When the vaporizer 10 needs to be replaced, the vaporizer 10 may be detached and a new vaporizer 10 is installed on the main unit 20 to reuse the main unit 20.

Certainly, the electronic vaporization device 100 further includes other components in the existing electronic vaporization devices, such as a microphone, a holder, and the like. Specific structures and functions of these components are the same as or similar to those in the related art, and for details, reference may be made to the related art, which are not described herein again.

Figure 2A:
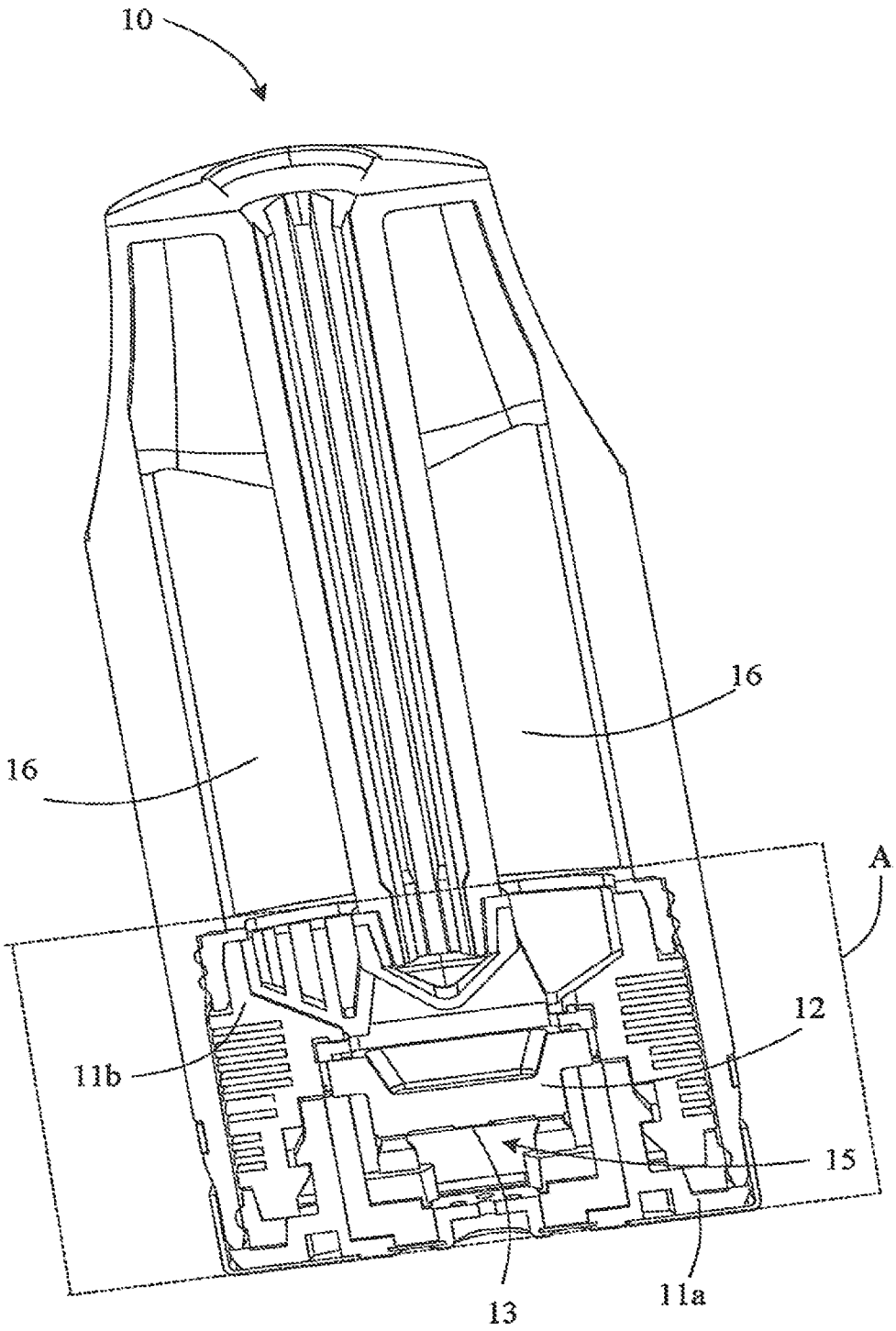
FIG. 2*a* is a schematic structural diagram of a vaporizer according to an embodiment of this application.
Figure 2B:
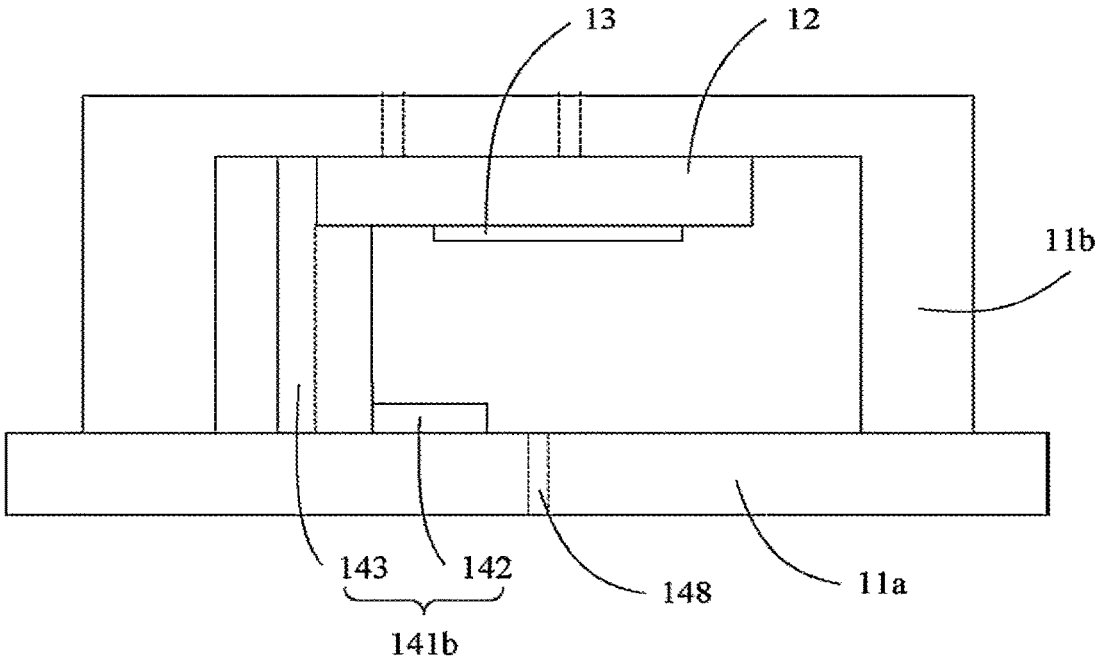
FIG. 2*b* is a schematic diagram of a local structure of A in FIG. 2*a*.

In a specific embodiment, referring to FIG. 2*a* and FIG. 2*b*, FIG. 2*a* is a schematic structural diagram of a vaporizer according to an embodiment of this application; and FIG. 2*b* is a schematic diagram of a local structure of A in FIG. 2*a*. The vaporizer 10 includes a bottom plate 11*a*, a vaporization base 11*b*, a vaporization core 12, and a liquid guiding assembly 141*b*.

The bottom plate 11*a* may be a horizontal panel and has a first surface and a second surface arranged opposite to the first surface. The vaporization base 11*b* is arranged on and covers the first surface of the bottom plate 11*a* and cooperates with the first surface of the bottom plate 11*a* to form a vaporization cavity 15. Specifically, the vaporization base 11*b* includes a side wall and a top wall that cooperate to form a concave-shaped structure, and the concave-shaped vaporization base 11*b* cooperates with the first surface of the bottom plate 11*a* to form the vaporization cavity 15. The vaporization core 12 is accommodated in the vaporization cavity 15 for heating and vaporizing liquid in the vaporization cavity 15 when energized. The liquid guiding assembly 141*b* is configured to absorb liquid on the bottom plate 11*a*.

In a specific embodiment, the electronic vaporization device 100 further includes a liquid storage cavity 16 configured to store liquid. Liquid flowing holes are provided on the top wall of the vaporization base 11*b*, where one end of each liquid flowing hole is in communication with the liquid storage cavity 16, and the other end of each liquid flowing hole is in communication with the vaporization cavity 15. Several liquid absorbing holes are formed on the vaporization core 12, where one end of each liquid absorbing hole is in communication with a liquid flowing hole, and the other end of each liquid absorbing hole is in communication with the vaporization cavity 15, so that the liquid in the liquid storage cavity 16 can flow to the surface of the vaporization core 12 through the liquid flowing holes and the liquid absorbing holes. Specifically, the vaporization core 12 is arranged on the liquid guiding assembly 141*b*, so that the liquid guiding assembly 141*b* supports the vaporization core 12, and the side surface of the vaporization core 12 away from the liquid guiding assembly 141*b* abuts against the top wall of the vaporization base 11*b* to prevent liquid leakage. In an embodiment, the vaporization core 12 may be porous ceramic, and micropores of the vaporization core 12 form the liquid absorbing holes.

In a specific embodiment, the vaporizer 10 further includes a heating body 13 specifically arranged on the side surface of the vaporizer core 12 away from the vaporization base 11*b* for heating and vaporizing liquid on the surface of the vaporizer core 12 when energized, and specifically, the heating body 13 may be a heating film arranged on the surface of the vaporizer core 12.

Figure 3A:
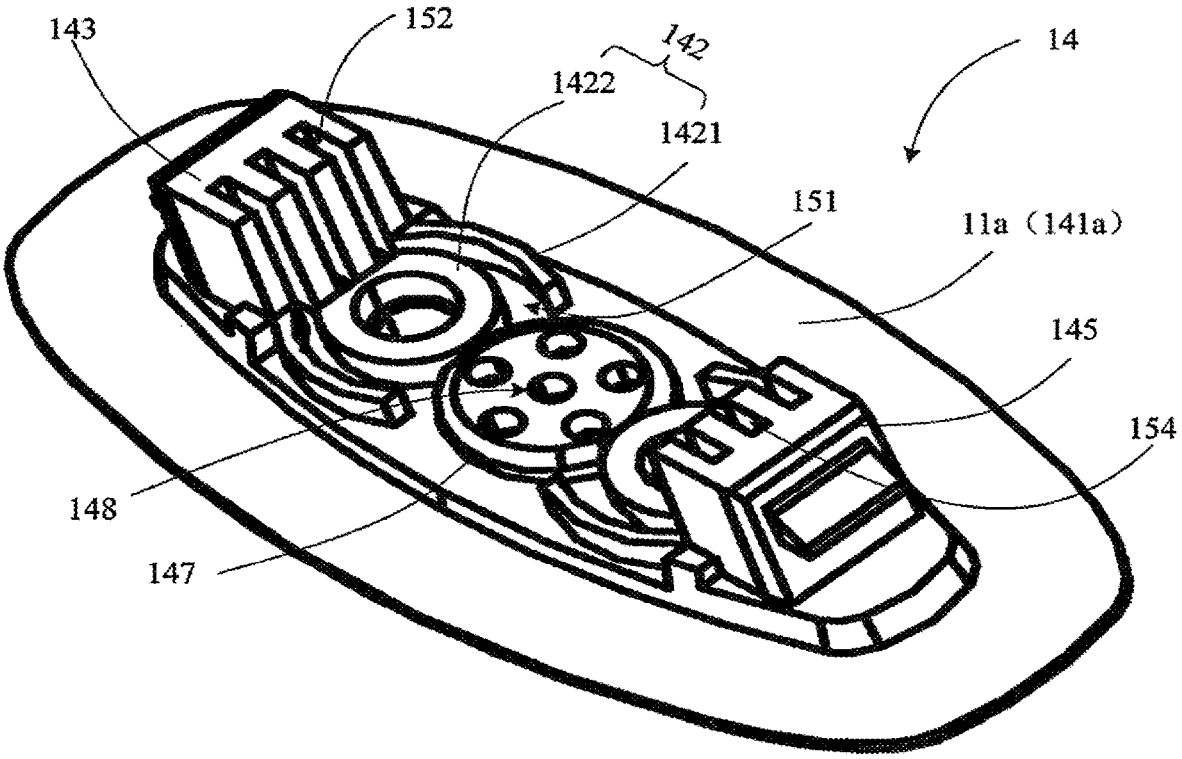
FIG. 3*a* is a schematic structural diagram of a vaporization base according to a first embodiment of this application.
Figure 3B:
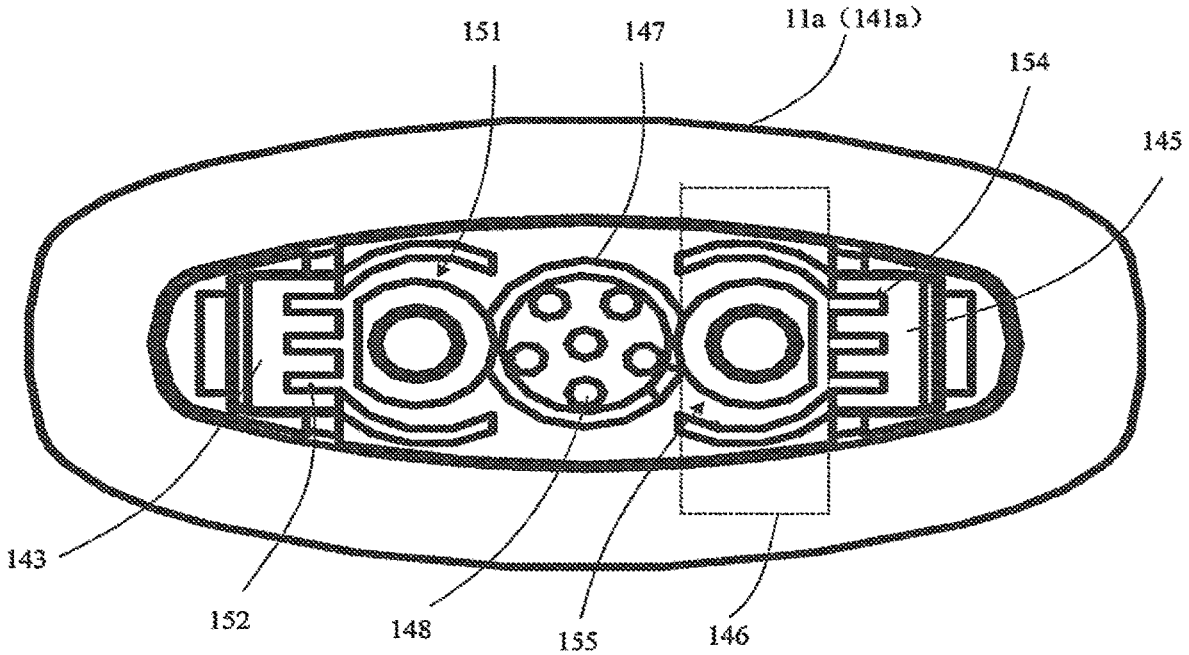
FIG. 3*b* is a top view of FIG. 3*a*.
Figure 3C:
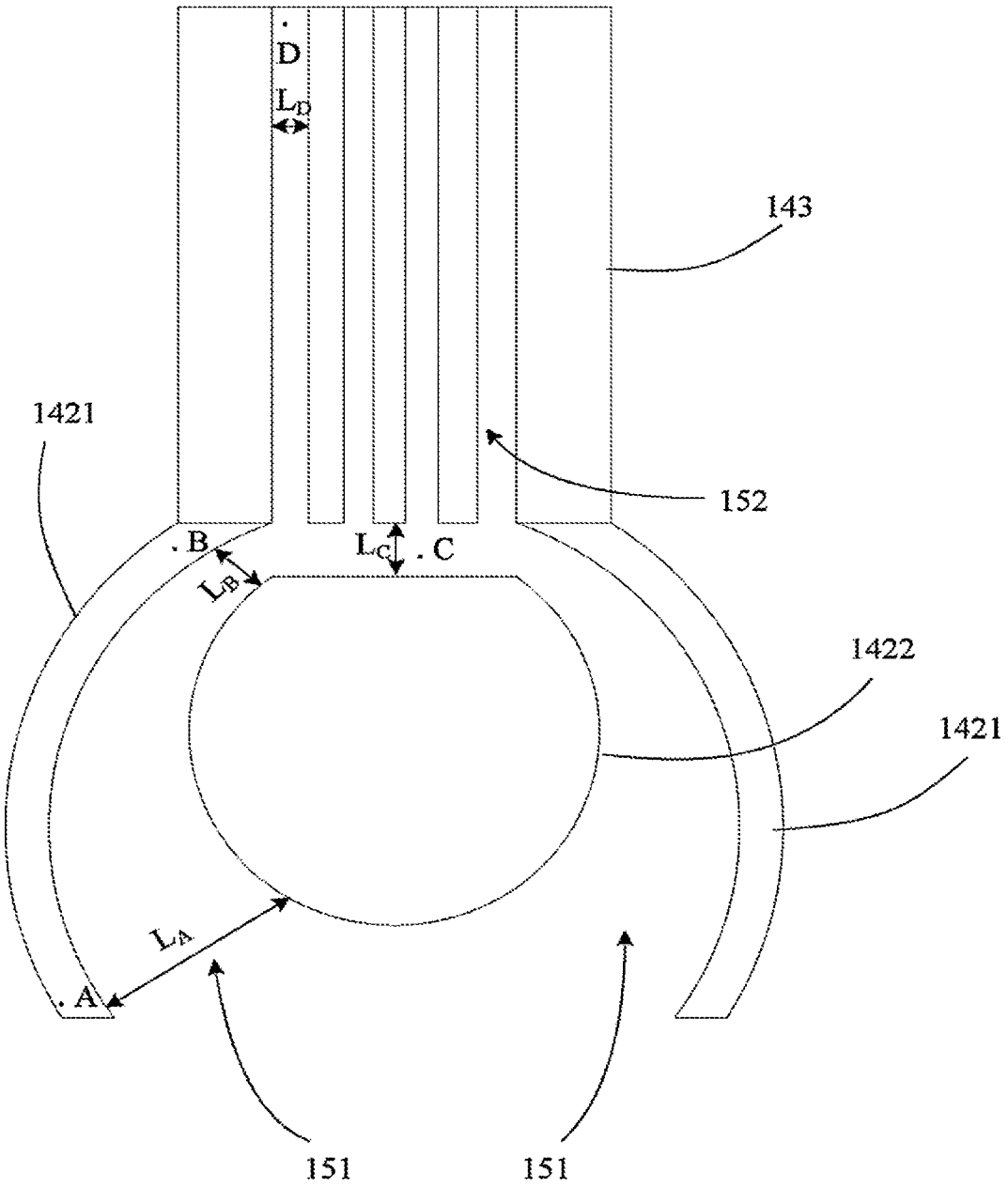
FIG. 3*c* is a schematic plan view of a first liquid guiding portion and a second liquid guiding portion according to an embodiment of this application.

Specifically, referring to FIG. 3*a* to FIG. 3*c*, FIG. 3*a* is a schematic structural diagram of a vaporization base according to a first embodiment of this application, FIG. 3*b* is a top view of FIG. 3*a*, and FIG. 3*c* is a schematic plan view of a first liquid guiding portion and a second liquid guiding portion according to an embodiment of this application. The liquid guiding assembly 141*b* includes a first liquid guiding portion 142 and a second liquid guiding portion 143. In an embodiment, the second liquid guiding portion 143 is arranged on the first surface of the bottom plate 11*a* and is perpendicular to the first surface of the bottom plate 11*a*; and the vaporization core 12 is specifically arranged on one end of the second liquid guiding portion 143 away from the first liquid guiding portion 142.

A boss 147 is formed on the first surface of the bottom plate 11*a*, several air inlet holes 148 are formed on the boss 147 and run through upper and lower surfaces of the boss 147, and external air may enter the vaporization cavity 15 through the air inlet holes 148. By causing end openings of ends of the air inlet holes 148 facing the vaporization core 12 to be higher than the first surface of the bottom plate 11*a*, liquid on the first surface of the bottom plate 11*a* can be prevented from leaking out through the air inlet holes 148. Specifically, the bottom plate 11*a* may be elliptical, the boss 147 is specifically formed at a central position of the elliptical bottom plate 11*a*, and with one air inlet hole 148 as a center, the remaining air inlet holes 148 are evenly distributed around the air inlet hole 148.

The first liquid guiding portion 142 is arranged on the first surface of the bottom plate 11*a* and cooperates with the first surface of the bottom plate 11*a* to form at least one first liquid guiding channel 151. In a specific embodiment, the first liquid guiding portion 142 may be integrally formed with the bottom plate 11*a*, and may specifically be made of dense ceramic. The second liquid guiding portion 143 is arranged on the first surface of the bottom plate 11*a* and has at least one second liquid guiding channel 152, where one end of the second liquid guiding channel 152 is in communication with the first liquid guiding channel 151, so as to guide the liquid on the first surface of the bottom plate 11*a* to the vaporization core 12 through the first liquid guiding channel 151 and the second liquid guiding channel 152. Specifically, a horizontal size of the first liquid guiding channel 151 gradually decreases in a direction toward the second liquid guiding portion 143, so that a capillary force of the first liquid guiding channel 151 gradually increases in the direction toward the second liquid guiding portion 143, thereby absorbing and guiding the liquid on the first surface of the bottom plate 11*a* by this gradually increasing capillary force. That is, an additional power is provided for the liquid on the first surface of the bottom plate 11*a* to reflux to the second liquid guiding portion 143, so that the liquid on the first surface of the bottom plate 11*a* can flow into the first liquid guiding channel 151 and flow to the second liquid guiding portion 143 through the second liquid guiding channel 152 in communication with the first liquid guiding channel 151. In this way, the second liquid guiding portion 143 is used to store the liquid accumulated on the first surface of the bottom plate 11*a*, thereby greatly reducing a probability that the liquid on the first surface of the bottom plate 11*a* leaks out through the inlet holes 148 and results in a problem of liquid leakage.

In a specific embodiment, the other end of the second liquid guiding channel 152 is in communication with the vaporization core 12, and a capillary force of the second liquid guiding channel 152 is smaller than a capillary force of the vaporization core 12, so as to guide the liquid on the bottom plate 11*a* to the vaporization core 12 or the liquid storage cavity 16 in communication with the vaporization core 12 through the first liquid guiding channel 151 and the second liquid guiding channel 152, thereby realizing reflux of the liquid on the bottom plate 11*a* to improve the utilization rate of the liquid. Compared with a rectangular liquid absorbing groove in the related art, the components in this application can not only greatly reduce the probability of liquid leakage, but also absorb and guide the liquid on the surface of the bottom plate 11*a* by the gradually increasing capillary force of a liquid guiding groove with a changing diameter, thereby effectively increasing a reflux volume of the liquid. It may be understood that a regular liquid absorbing through groove with an unchanging diameter (that is, a horizontal size remains unchanged) does not have a one-way liquid guiding function, while a liquid guiding channel with a changing diameter (that is, a horizontal size changes) can provide a power for liquid to flow from a large-scale part to a small-scale part of the channel. Because the small-scale part of the liquid guiding channel has a more apparent capillary phenomenon, the liquid can flow to a part of the liquid guiding channel with a smaller horizontal size, thereby reducing a liquid leakage volume. The horizontal size specifically refers to a relative distance between two side walls of the liquid guiding channel.

In addition, in a case that there is much liquid formed due to condensation or the like in the second liquid guiding channel 152, because sizes gradually increase from the second liquid guiding channel 152 to the first liquid guiding channel 151 during a downward flowing process, certain resistance can be generated to the downward flowing trend, so as to prevent the liquid from flowing to the first surface of the bottom plate 11*a*, thereby facilitating the liquid to flow to the vaporization core 12.

Specifically, referring to FIG. 3*a* and FIG. 3*b*, the first liquid guiding channel 151 is a first liquid guiding groove formed on the first surface of the bottom plate 11*a*. Certainly, in other embodiments, the first liquid guiding channel 151 may also be a first liquid guiding hole formed on the first surface of the bottom plate 11*a*; and specifically, tops of a first protruding portion and a second protruding portion are connected. In this case, the first liquid guiding channel 151 is the first liquid guiding hole.

In a specific embodiment, the first liquid guiding portion 142 may specifically include a first protruding portion and a second protruding portion that are arranged apart from each other, and the first protruding portion and the second protruding portion as well as the first surface of the bottom plate 11*a* define at least one first liquid guiding groove.

In an embodiment, the surface of the first protruding portion close to the second protruding portion is an inner arc surface, and the surface of the second protruding portion close to the first protruding portion is an outer arc surface. In this embodiment, the first protruding portion and the second protruding portion cooperate with the first surface of the bottom plate 11*a* to form an arc-shaped first liquid guiding groove.

In a specific embodiment, the first protruding portion includes two arc protrusions 1421, and the second protruding portion is an annular protrusion 1422. The two arc protrusions 1421 are oppositely arranged on two sides of the annular protrusion 1422 and apart from the annular protrusion 1422. One end of each arc protrusion 1421 abuts against an edge of the second liquid guiding portion 143, the other end of each arc protrusion 1421 extends in a direction away from the second liquid guiding portion 143, and a relative distance between each arc protrusion 1421 and the annular protrusion 1422 decreases gradually in a direction toward the second liquid guiding portion 143, so as to cooperate with the first surface of the bottom plate 11*a* to form two first liquid guiding grooves. It may be understood that the relative distance between each arc protrusion 1421 and the annular protrusion 1422 is a horizontal size of the first liquid guiding groove.

In an embodiment, the two arc protrusions 1421 are arranged on the same circular arc, and the circular arc is arranged eccentrically with a circular arc on which the annular protrusion 1422 is arranged. That is, a center of the circular arc on which the two arc protrusions 1421 are arranged is arranged at a different position from a center of the circular arc on which the annular protrusion 1422 is arranged, so that the relative distance between each arc protrusion 1421 and the annular protrusion 1422 decreases gradually in the direction toward the second liquid guiding portion 143.

In a specific embodiment, the annular protrusion 1422 is circular and the surface of the annular protrusion 1422 close to the second liquid guiding portion 143 has a tangent plane, and a vertical distance between the tangent plane and the second liquid guiding portion 143 is smaller than a horizontal size of a part of the first liquid guiding channel 151 close to the second liquid guiding portion 143. In this way, the tangent plane and the second liquid guiding portion 143 as well as the first surface of the bottom plate 11*a* define a channel whose horizontal size is smaller than the horizontal size of the first liquid guiding channel 151. Therefore, a capillary force of this channel is greater than the capillary force of the first liquid guiding channel 151, so as to absorb and guide liquid in the first liquid guiding channel 151 and cause the liquid to further flow toward the channel, enter another second liquid guiding channel 152 corresponding to the channel, and reflux to the vaporization core 12.

It may be understood that, in this embodiment, referring to FIG. 3*c*, the horizontal sizes of the first liquid guiding channel 151 and the at least one second liquid guiding channel 152 gradually decrease from a position A to a position D, that is, LA>LB>LC>LD, so that liquid can be collected at the position A and guided to a position B. After this, a part of the liquid flows to the position D through a first second liquid guiding channel 152 to reflux to the vaporization core 12, while other part of the liquid flows to other second liquid guiding channels 152 through a channel corresponding to a position C, so as to reflux to the vaporization core 12 through another second liquid guiding channel 152 rather than the first second liquid guiding channel 152. The liquid thereby refluxes from the first surface of the bottom plate 11*a* to the vaporization core 12.

Specifically, as experiment results show, after dripping liquid to the first surface of the bottom plate 11*a*, one end of the first liquid guiding channel 151 away from the second liquid guiding portion 143 may guide the liquid into the first liquid guiding channel 151, and the liquid may flow smoothly to a second liquid guiding channel 152 closest to the first liquid guiding channel 151. After filling the closest second liquid guiding channel 152, the liquid flows further to a second liquid guiding channel 152 slightly further from the first liquid guiding channel 151 through the channel corresponding to the position C until all the second liquid guiding channels 152 are filled.

Figure 4A:
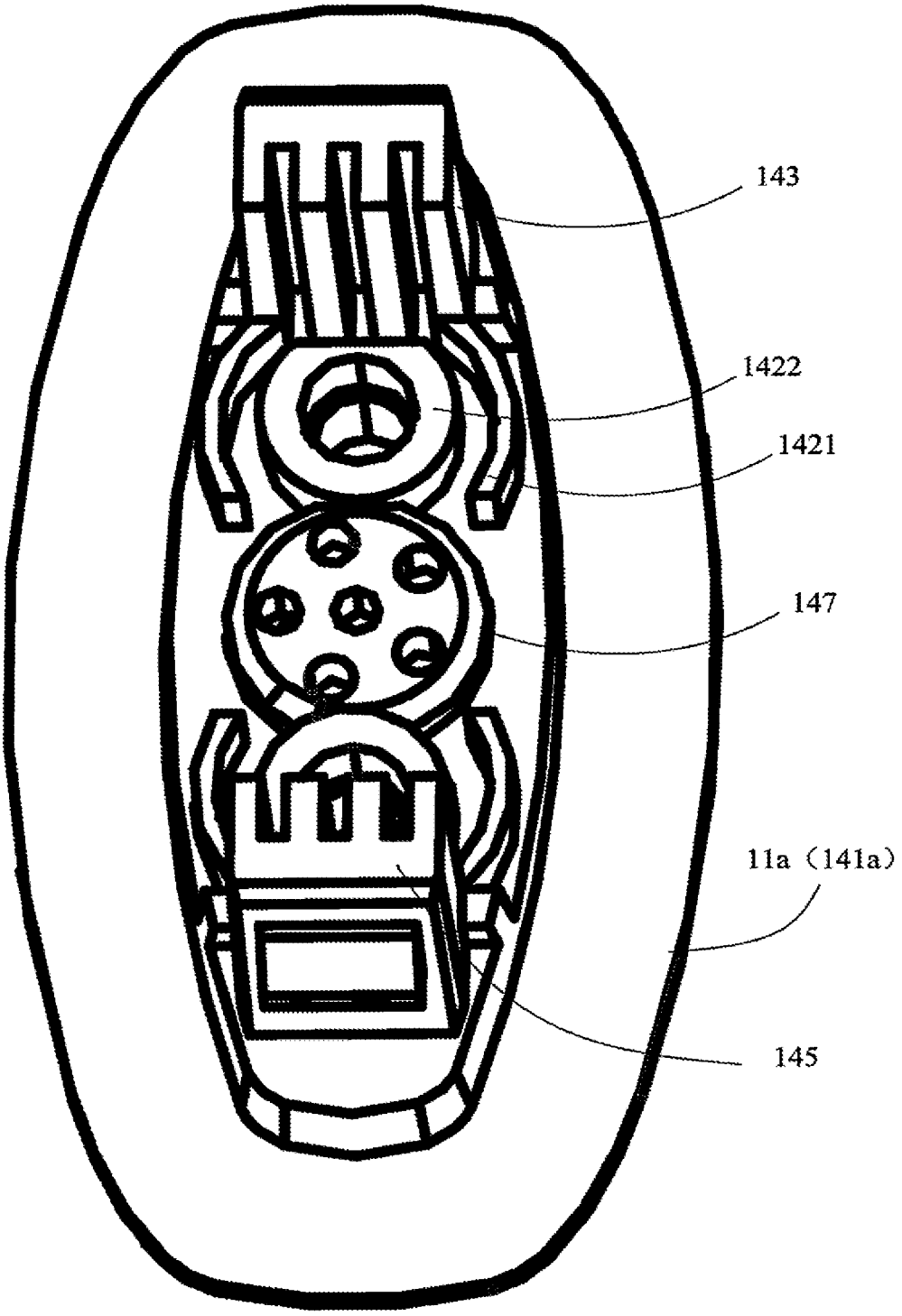
FIG. 4*a* is a schematic structural diagram of a vaporization base according to a second embodiment of this application.
Figure 4B:
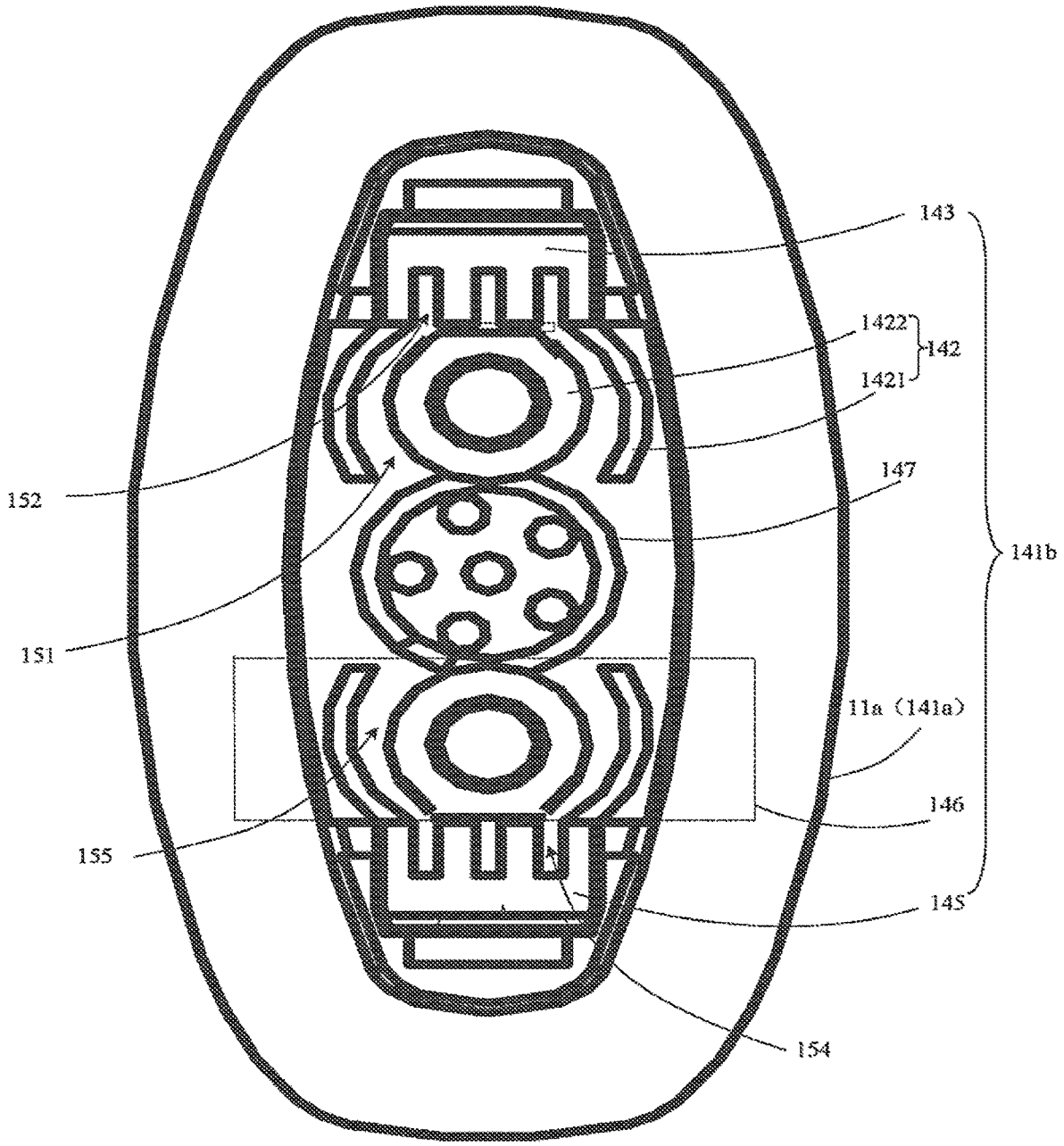
FIG. 4*b* is a top view of FIG. 4*a*.

In an embodiment, referring to FIG. 4*a* and FIG. 4*b*, where FIG. 4*a* is a schematic structural diagram of a vaporization base according to a second embodiment of this application; and FIG. 4*b* is a top view of FIG. 4*a*. The tangent plane of the annular protrusion 1422 abuts against the second liquid guiding portion 143 to form two independent first liquid guiding channels 151. In this way, the liquid on the first surface of the bottom plate 11*a* can be dealt with at different positions, so that liquid passing through a particular first liquid guiding channel 151 can reflux to the vaporization core 12 through several second liquid guiding channels 152 in communication with the particular first liquid guiding channel 151. Moreover, the second liquid guiding channels 152 can be fully used to avoid a problem that the liquid accumulates in second liquid guiding channels 152 at edges but does not pass through second liquid guiding channels 152 in the middle. Meanwhile, a flow path of the liquid may be shortened, thereby greatly enhancing the reflux efficiency and reducing the probability of liquid leakage. In addition, the two first liquid guiding channels 151 are provided independently, so as to avoid a problem that the liquid on the first surface of the bottom plate 11*a* enters one second liquid guiding channel 152 and then flows out to the first surface of the bottom plate 11*a* through the other first liquid guiding channel 151 in communication with the first liquid guiding channel 151 In a specific embodiment, each first liquid guiding channel 151 is in communication with at least two second liquid guiding channels 152.

Figure 5A:
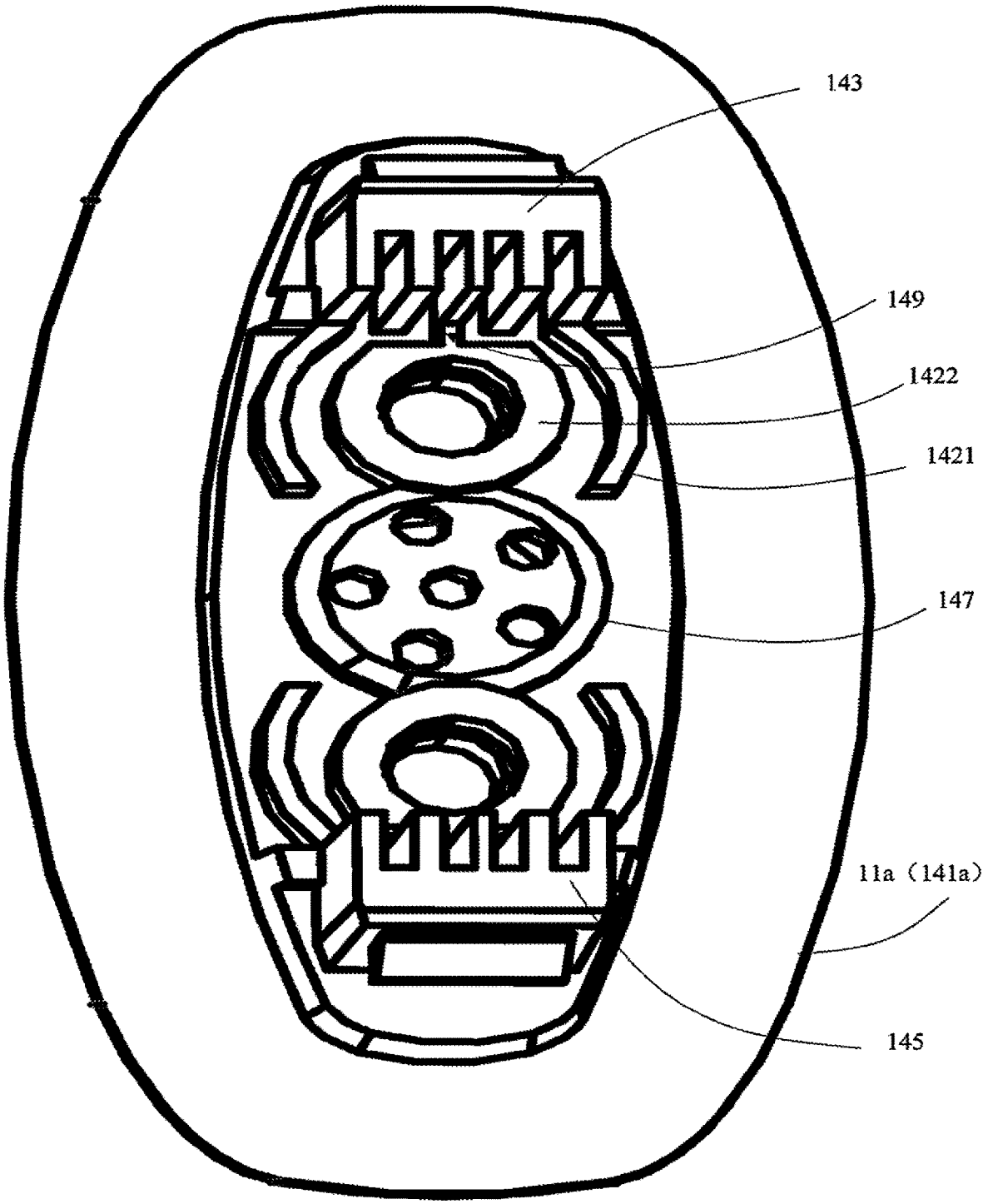
FIG. 5*a* is a schematic structural diagram of a vaporization base according to a third embodiment of this application.
Figure 5B:
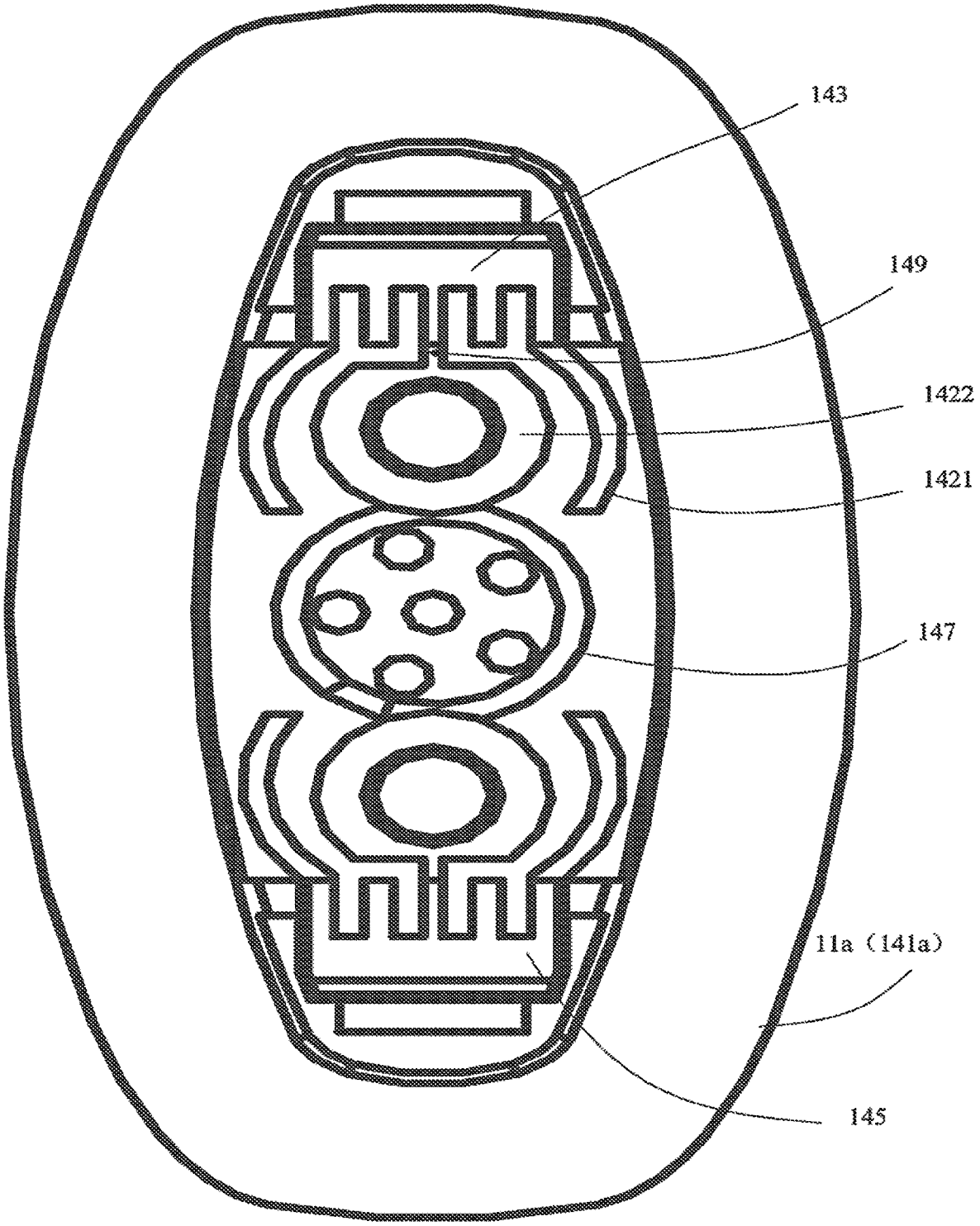
FIG. 5*b* is a top view of FIG. 5*a*.
Figure 5C:
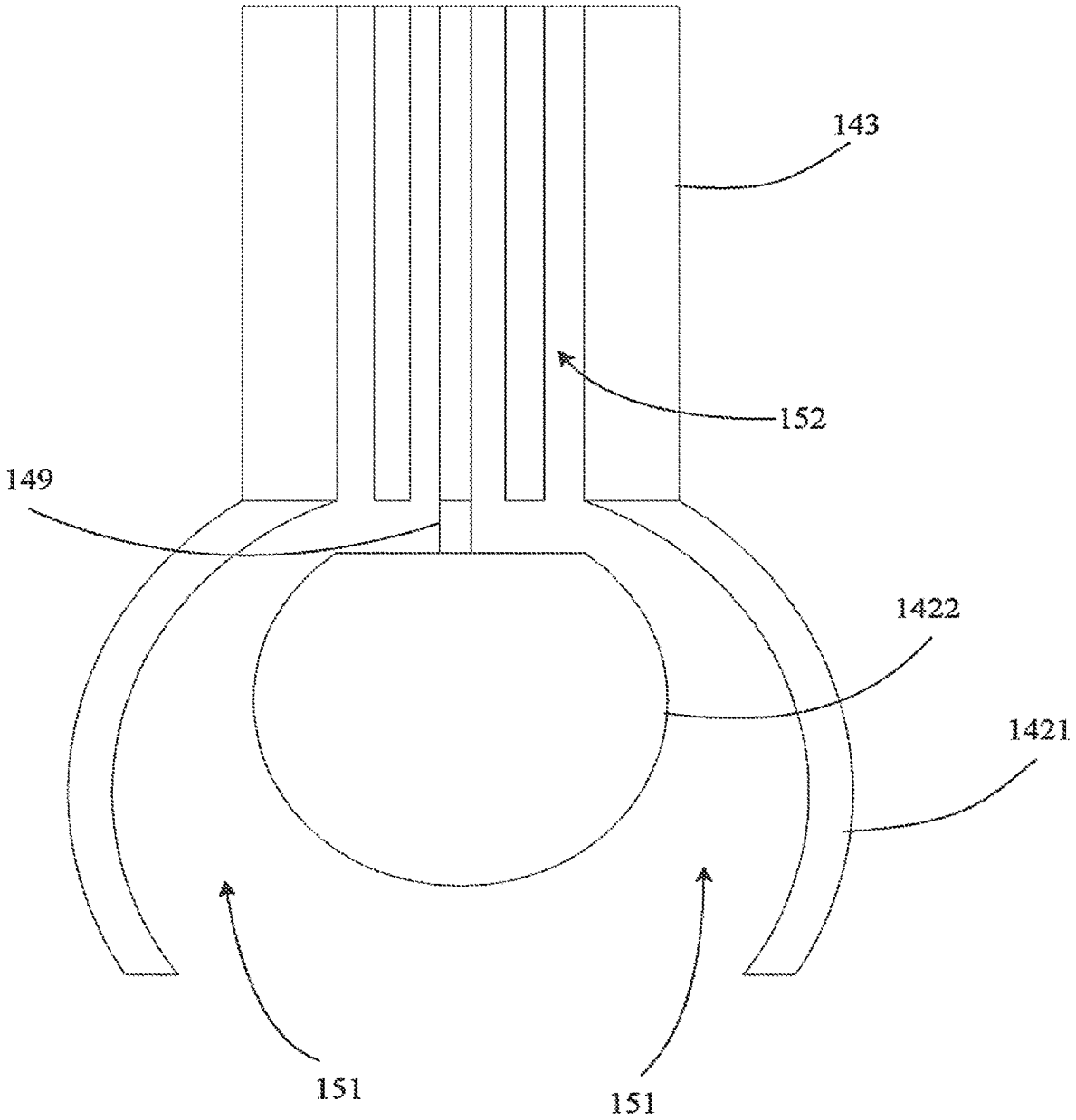
FIG. 5*c* is a schematic plan view of a first liquid guiding portion and a second liquid guiding portion according to another embodiment of this application.

In another embodiment, referring to FIG. 5*a* to FIG. 5*c*, where FIG. 5*a* is a schematic structural diagram of a vaporization base according to a third embodiment of this application; FIG. 5*b* is a top view of FIG. 5*a*; and FIG. 5*c* is a schematic plan view of a first liquid guiding portion and a second liquid guiding portion according to another embodiment of this application. The first liquid guiding portion 142 further includes a baffle 149, the annular protrusion 1422 and the second liquid guiding portion 143 are arranged apart from each other, and the baffle 149 is arranged between the annular protrusion 1422 and the second liquid guiding portion 143 to separate the two first liquid guiding channels 151 by the baffle 149, thereby forming two independent first liquid guiding channels 151, where each first liquid guiding channel 151 is in communication with at least two second liquid guiding channels 152.

Specifically, the baffle 149 is arranged between the tangent plane of the annular protrusion 1422 and the second liquid guiding portion 143 and may specifically be a rectangular plate.

In a specific embodiment, the annular protrusion 1422 is a mounting base 12 for an electrode ejector pin and is specifically configured to mount the electrode ejector pin.

Specifically, referring to FIG. 3*a*, the foregoing second liquid guiding channels 152 extend from one end portion of the second liquid guiding portion 143 to the first surface of the bottom plate 11*a*, and the horizontal size of the second liquid guiding channels 152 is smaller than that of ends of the first liquid guiding channels 151 close to the second liquid guiding portion 143. In a specific embodiment, the horizontal size of the second liquid guiding channels 152 is smaller than that of the first liquid guiding channel 151, so as to absorb and guide the liquid in the first liquid guiding channel 151 and cause the liquid to flow in a direction toward the second liquid guiding channels 152 to further flow to the vaporization core 12. The second liquid guiding channels 152 extend from the end portion of the second liquid guiding portion 143 to the first surface of the bottom plate 11*a*, so that liquid at any position on the first surface of the bottom plate 11*a* can fully use the second liquid guiding channels 152.

In a specific embodiment, the second liquid guiding portion 143 is made of a porous material. For example, the second liquid guiding portion 143 may be porous ceramic, and micropores of the second liquid guiding portion 143 form the second guiding channels 152, that is, the liquid in the first guiding channels 151 flows to the vaporization core 12 through the micropores of the second liquid guiding portion 143 itself.

Figure 6:
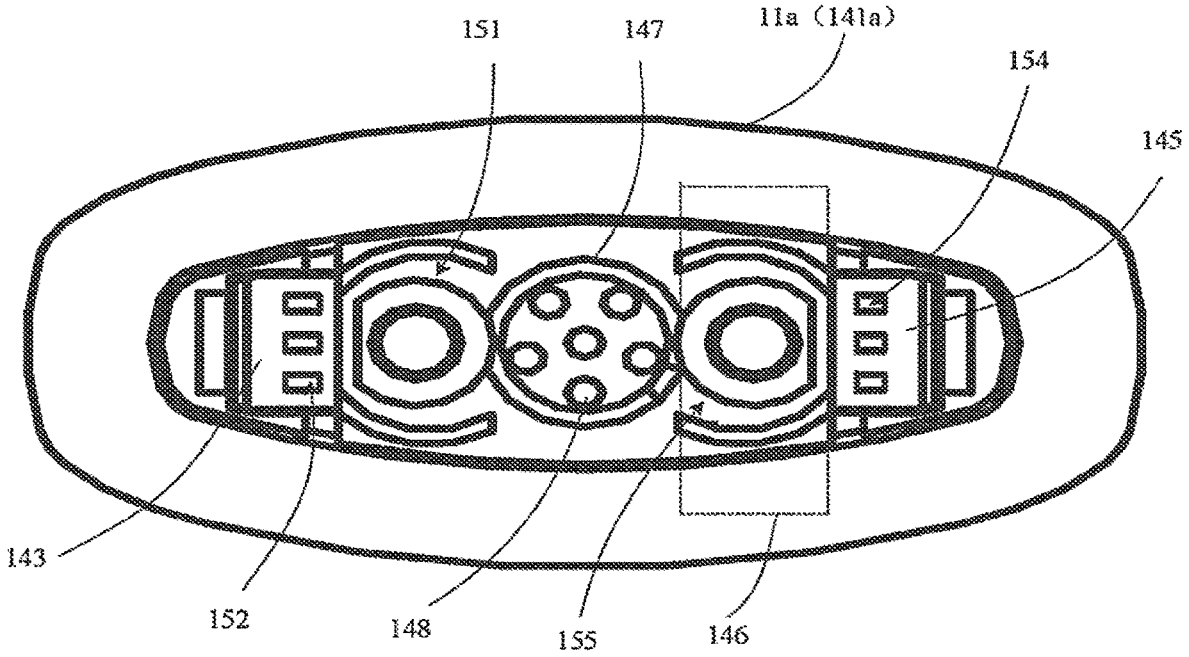
FIG. 6 is a top view of a vaporization base according to an embodiment of this application.

In another specific embodiment, the second liquid guiding portion 143 may be made of dense ceramic, and the second liquid guiding channels 152 may be liquid guiding holes formed on the second liquid guiding portion 143, where the liquid guiding holes are in communication with the first liquid guiding channel 151. For details, referring to FIG. 6, where FIG. 6 is a top view of a vaporization base according to an embodiment of this application. Alternatively, the second liquid guiding channels 152 are second liquid guiding grooves formed on the second liquid guiding portion 143 (referring to FIG. 3*a*), and specifically, openings of the second liquid guiding grooves face the first liquid guiding channel 151, which is taken as an example in the following embodiments.

Figure 7:
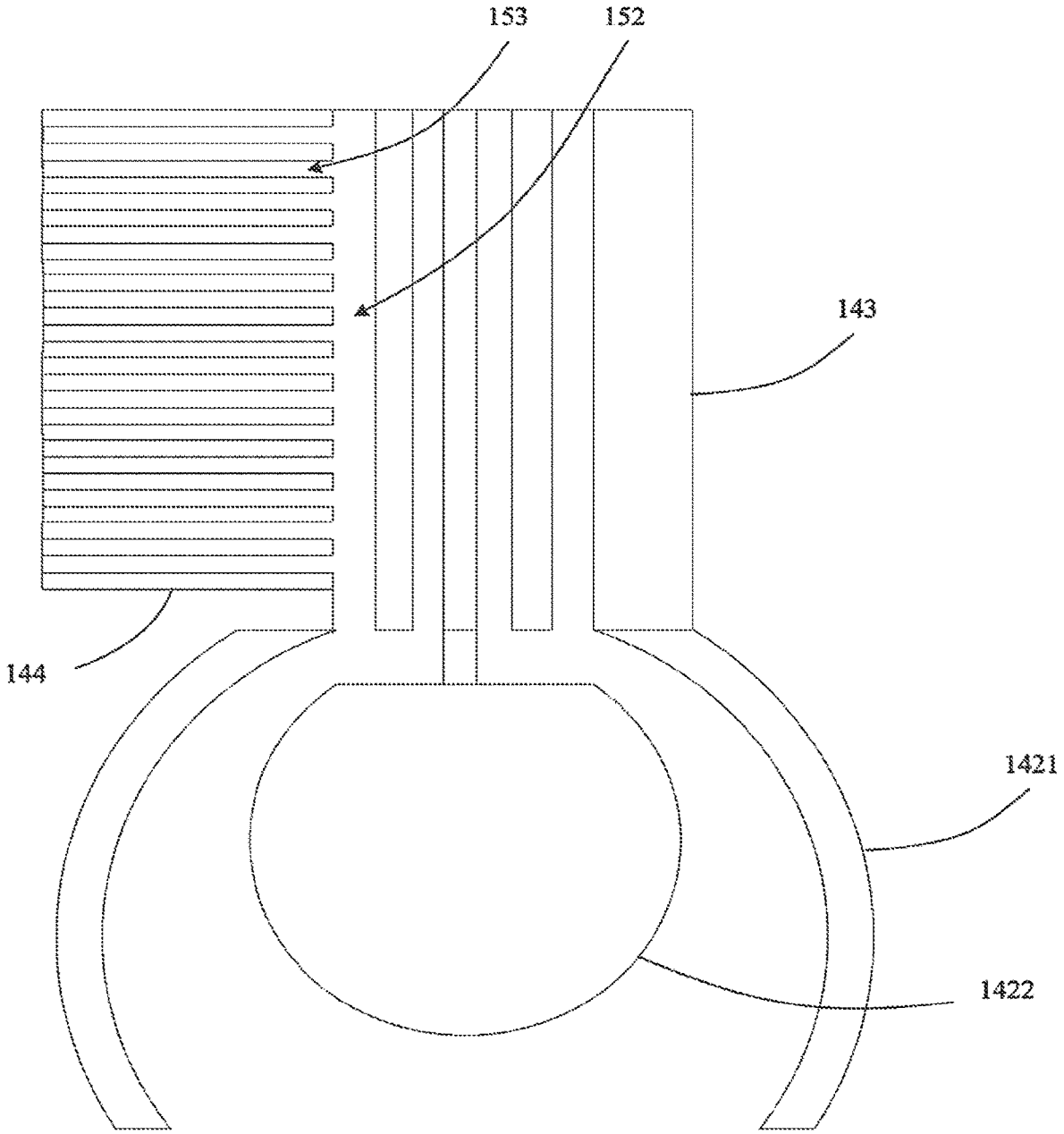
FIG. 7 is a schematic plan view of a first liquid guiding portion, a second liquid guiding portion, and a third liquid guiding portion according to an embodiment of this application.

FIG. 7 is a schematic plan view of a first liquid guiding portion, a second liquid guiding portion, and a third liquid guiding portion according to an embodiment of this application. In an embodiment, to further enhance the liquid absorbing capability of the liquid guiding assembly 141*b*, the liquid guiding assembly 141*b* further includes a third liquid guiding portion 144 that is specifically arranged on the side wall of the second liquid guiding portion 143 and is perpendicular to the second liquid guiding portion 143. Specifically, at least one third liquid guiding channel 153 is formed on the third liquid guiding portion 144, one end of each third guiding channel 153 is in communication with at least one second guiding channel 152 of the second liquid guiding portion 143, and a capillary force of the third liquid guiding channel 153 is greater than the capillary force of the second guiding channel 152, so as to guide the liquid absorbed by the first liquid guiding portion 142 by the capillary force of the first liquid guiding channel 151 to the third liquid guiding portion 144, thereby storing the liquid by using the third liquid guiding portion 144 and preventing liquid leakage. In a specific embodiment, the third liquid guiding portion 144 may be a part of the vaporization core 12, that is, the part of the vaporization core 12 extends toward the second liquid guiding portion 143 and abuts against the side wall of the second liquid guiding portion 143, and the micropores on the vaporization core 12 form the third liquid guiding channel 153.

In a specific embodiment, the other end of the third liquid guiding channel 153 is in communication with the vaporization core 12, and the capillary force of the third liquid guiding channel 153 is smaller than the capillary force of the vaporization core 12, so as to guide the liquid on the bottom plate 11*a* to the vaporization core 12 through the first liquid guiding channel 151, the second liquid guiding channel 152, and the third liquid guiding channel 153, thereby causing the liquid on the surface of the bottom plate 11*a* to reflux to increase the liquid utilization. Specifically, a vertical groove is provided on one end of the third liquid guiding portion 144 away from the second liquid guiding channel 152, the vertical groove extends to an end of the third liquid guiding portion 144 close to the vaporization core 12 and is in communication with the micropores on the vaporization core 12. In a specific embodiment, one end of each third liquid guiding channel 153 on the third liquid guiding portion 144 away from the second liquid guiding channel 152 is in communication with the vertical groove to realize communication with the vaporization core 12 through the vertical groove. Certainly, in other embodiments, the end of each third liquid guiding channel 153 away from the second liquid guiding channel 152 may also be an open end, a part of the vaporization core 12 extends in a direction toward the bottom plate 11*a* and abuts against the side wall of the third liquid guiding portion 144 away from the second liquid guiding portion 143, thereby realizing communication between the third liquid guiding channels 153 and the vaporization core 12.

Specifically, the horizontal size of the third liquid guiding channels 153 is smaller than the horizontal size of the second liquid guiding channel 152 to further absorb and guide liquid in the second liquid guiding channel 152 by the capillary force of the third liquid guiding channels 153, so that the liquid flows toward the third liquid guiding channels 153 and refluxes to the vaporization core 12. In a specific embodiment, one end of each third liquid guiding channel 153 is specifically in communication with a second liquid guiding channel 152 at an edge of the second liquid guiding portion 143.

Specifically, both the third liquid guiding channel 153 and the second liquid guiding channel 152 may be linear channels, and the third liquid guiding channel 153 and the second liquid guiding channel 152 are arranged perpendicularly. In a specific embodiment, the third liquid guiding channel 153 may also be a liquid guiding groove or a liquid guiding hole, which is not limited in this embodiment.

Still referring to FIG. 3 to FIG. 7, in this embodiment, the liquid guiding assembly 141*b* further includes a fourth liquid guiding portion 145, where the fourth liquid guiding portion 145 and the second liquid guiding portion 143 are symmetrically arranged on two sides of the boss 147, that is, symmetrically arranged on two sides of the air inlet holes 148 and on two opposite sides of the first liquid guiding portion 142. Specifically, the fourth liquid guiding portion 145 has at least one fourth liquid guiding channel 154, and one end of the fourth liquid guiding channel 154 is in communication with the first surface of the bottom plate 11*a* for guiding the liquid on the bottom plate 11*a* to the fourth liquid guiding portion 145 to store the liquid by the fourth liquid guiding portion 145.

In a specific embodiment, the other end of the fourth liquid guiding portion 145 is configured to be in communication with the vaporization core 12 for guiding the liquid on the first surface of the bottom plate 11*a* to the vaporization core 12. Specifically, a specific structure and a function of the fourth liquid guiding portion 145 are the same as or similar to a structure and a function of the second liquid guiding portion 143, and the same or similar technical effects may be achieved. For details, reference may be made to the foregoing relevant written records, which are not described herein again.

Specifically, in this embodiment, the vaporization core 12 is arranged on ends of the second liquid guiding portion 143 and the fourth liquid guiding portion 145 away from the bottom plate 11*a*, and abuts against the second liquid guiding portion 143 and the fourth liquid guiding portion 145. In this way, the second liquid guiding portion 143 and the fourth liquid guiding portion 145 provide certain support to the vaporization core 12, and meanwhile, liquid passing through the second liquid guiding portion 143 and/or the fourth liquid guiding portion 145 can reflux to the vaporization core 12. It may be understood that in other embodiments, the fourth liquid guiding portion 145 may be also not provided with any fourth guiding channel 154 and only provides certain support to the vaporization core 12.

Furthermore, the liquid guiding assembly 141*b* further includes a fifth liquid guiding portion 146 arranged on the first surface of the bottom plate 11*a*, the fifth liquid guiding portion 146 cooperates with the first surface of the bottom plate 11*a* to form at least one fifth liquid guiding channel 155, one end of the fourth guiding channel 154 is in communication with the fifth guiding channel 155 to be in communication with the first surface of the bottom plate 11*a*. A capillary force of the fourth liquid guiding channel 154 is greater than a capillary force of the fifth liquid guiding channel 155, so that liquid absorbed by the fifth liquid guiding portion 146 by the capillary force of the fifth liquid guiding channel 155 is guided to the fourth liquid guiding portion 145. In a specific embodiment, a structure and a function of the fifth liquid guiding portion 146 are the same as or similar to a structure and a function of the first liquid guiding portion 142, and the same or similar technical effects may be achieved. For details, reference may be made to the foregoing relevant written records, which are not described herein again. Specifically, the fifth liquid guiding portion 146 is arranged between the second liquid guiding portion 143 and the fourth liquid guiding portion 145, and in a specific embodiment, the fifth liquid guiding portion 146 and the first liquid guiding portion 142 are symmetrically arranged on the two sides of the boss 147, that is, symmetrically arranged on the two sides of the air inlet holes 148. It may be understood that a horizontal size of the fifth liquid guiding channel 155 gradually decreases in a direction toward the fourth liquid guiding channel 154 to absorb and guide the liquid on the first surface of the bottom plate 11*a*, so that the liquid on the first surface of the bottom plate 11*a* can reflux to the vaporization core 12 through the fifth liquid guiding channel 155 and fourth liquid guiding channel 154 to further increase a reflux volume and the reflux efficiency of the liquid on the first surface of the bottom plate 11*a*.

Certainly, in a specific embodiment, a third liquid guiding portion 144 may also be arranged on the side wall of the fourth liquid guiding portion 145 to improve the liquid absorbing capability. For a specific arrangement method, reference may be made to the foregoing arrangement method for arranging the third liquid guiding portion 144 on the side wall of the second liquid guiding portion 143, which is not described herein again.

According to the vaporizer 10 provided in this embodiment, by arranging the bottom plate 11*a* and arranging the first liquid guiding portion 142 on the first surface of the bottom plate 11*a*, the first liquid guiding portion 142 cooperates with the bottom plate 11*a* to form at least one first liquid guiding channel 151. Meanwhile, the second liquid guiding portion 143 is arranged on the first surface of the bottom plate 11*a*, at least one second liquid guiding channel 152 is formed on the second liquid guiding portion 143, one end of the second liquid guiding channel 152 is in communication with the first liquid guiding channel 151, and the horizontal size of the first liquid guiding channel 151 gradually decreases in the direction toward the second liquid guiding portion 143. In this way, the capillary force of the first liquid guiding channel 151 increases gradually in the direction toward the second liquid guiding portion 143, and the gradually increasing capillary force is used to absorb and guide the liquid on the first surface of the bottom plate 11*a*; and meanwhile, the capillary force of the second liquid guiding channel 152 is greater than the capillary force of the first liquid guiding channel 151, so that the liquid absorbed by the first liquid guiding portion 142 by the capillary force of the first liquid guiding channel 151 is guided to the second liquid guiding portion 143. Therefore, the liquid on the bottom plate 11*a* is stored to greatly reduce the probability of liquid leakage of the vaporizer 10.

Still referring to FIG. 3*a* to FIG. 7, in this embodiment, a liquid guiding mechanism 14 is provided. The liquid guiding mechanism 14 specifically includes a base 141*a* and a liquid guiding assembly 141*b* arranged on the base 141*a*. The base 141*a* has a first surface and a second surface that are arranged opposite to each other, and the liquid guiding assembly 141*b* is arranged on the first surface of the base 141*a* for absorbing liquid on the base 141*a*.

In an embodiment, the liquid guiding mechanism 14 may be directly applied to the vaporizer 10 to absorb and guide liquid accumulated in the vaporizer cavity 15, thereby greatly reducing the probability of liquid leakage. Specifically, in this embodiment, the base 141*a* in the liquid guiding mechanism 14 may be directly used as the bottom plate 11*a* in the vaporizer 10 of the foregoing embodiment, that is, the base 141*a* of the liquid guiding mechanism 14 is formed into the bottom plate 11*a* of the vaporizer cavity. In this embodiment, a specific structure and a function of the base 141*a* are the same as or similar to a specific structure and a function of the bottom plate 11*a* in the vaporizer 10 provided in the foregoing embodiment, and the same or similar technical effects may be achieved. For details, reference may be made to the foregoing text description, which are not described herein again.

Certainly, in other embodiments, the liquid guiding mechanism 14 may also be directly arranged on the bottom plate 11*a* of the vaporizer 10. Specifically, a groove extending toward the second surface may be provided on the first surface of the bottom plate 11*a* of the vaporizer 10, the base 141*a* of the liquid guiding mechanism 14 is specifically arranged in the groove, and the first surface of the base 141*a* is flush with the first surface of the bottom plate 11*a* of the vaporizer 10, so that the liquid on the first surface of the bottom plate 11*a* can flow to the first surface of the base 141*a*, and the liquid guiding assembly 141*b* can absorb and guide the liquid on the first surface of the bottom plate 11*a*. It may be understood that in this embodiment, the boss 147 is formed on the base 141*a* and a through hole in communication with the air inlet holes 148 is formed on the base 141*a* to communicate the vaporization cavity 15 with external air.

A specific structure and a function of the liquid guiding assembly 141*b* are the same as or similar to a specific structure and a function of the liquid guiding assembly 141*b* in the vaporizer 10 provided in the foregoing embodiment, and the same or similar technical effects may be achieved. For details, reference may be made to the foregoing text description, which are not described herein again.

According to the liquid guiding mechanism 14 provided in this embodiment, by arranging the base 141*a* and arranging the first liquid guiding portion 142 on the first surface of the base 141*a*, the first liquid guiding portion 142 cooperates with the first surface of the base 141*a* to form at least one first liquid guiding channel 151. Meanwhile, the second liquid guiding portion 143 is arranged on the first surface of the base 141*a*, at least one second liquid guiding channel 152 is formed on the second liquid guiding portion 143, one end of the second liquid guiding channel 152 is in communication with the first liquid guiding channel 151, and the other end is configured to be in communication with the vaporization core 12. In this way, the liquid on the first surface of the base 141*a* can reflux to the vaporization core 12 through the first liquid guiding channel 151 and the second liquid guiding channel 152. In addition, the horizontal size of the first liquid guiding channel 151 gradually decreases in the direction toward the second liquid guiding portion 143, so that the capillary force of the first liquid guiding channel 151 increases in the direction toward the second liquid guiding portion 143 and the gradually increasing capillary force is used to absorb and guide the liquid on the first surface of the base 141*a*. In this way, the liquid on the first surface of the base 141*a* can flow into the first liquid guiding channel 151, and reflux to the vaporization core 12 through the second liquid guiding channel 152 in communication with the first liquid guiding channel 151. Compared with the related art, not only the probability of liquid leakage is greatly reduced, but also the reflux volume and reflux efficiency of the liquid are effectively increased by using the gradually increasing capillary force of the liquid guiding channel to absorb and guide the liquid on the surface of the base 141*a*.

The foregoing is merely implementations of this application but is not intended to limit the patent scope of this application. Any equivalent structural or equivalent process alternation made by using the content of the specification and the accompanying drawings of this application for direct or indirect use in other relevant technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a bottom plate comprising a first surface and a second surface arranged oppositely;

a vaporization base arranged on and covering the first surface of the bottom plate and cooperating with the first surface of the bottom plate to form a vaporization cavity;

a vaporization core accommodated in the vaporization cavity, the vaporization core being configured to heat and vaporize liquid in the vaporization cavity when energized; and a liquid guiding assembly configured to absorb liquid on the bottom plate, the liquid guiding assembly comprising:

a first liquid guiding portion arranged on the first surface of the bottom plate and cooperating with the first surface of the bottom plate to form at least one first liquid guiding channel; and a second liquid guiding portion comprising at least one second liquid guiding channel, one end of the second liquid guiding channel being in communication with the first liquid guiding channel, wherein a horizontal size of the first liquid guiding channel decreases gradually in a direction toward the second liquid guiding portion, and wherein a capillary force of the second liquid guiding channel is greater than a capillary force of the first liquid guiding channel such that liquid absorbed by the first liquid guiding portion by the capillary force of the first liquid guiding channel is guidable to the second liquid guiding portion.

2. The vaporizer of claim 1, wherein an other end of the second liquid guiding channel is in communication with the vaporization core, and wherein the capillary force of the second liquid guiding channel is smaller than a capillary force of the vaporization core so as to guide liquid on the bottom plate to the vaporization core through the first liquid guiding channel and the second liquid guiding channel.

3. The vaporization base of claim 2, wherein the second liquid guiding portion is arranged on the first surface of the bottom plate and is perpendicular to the first surface of the bottom plate.

4. The vaporizer of claim 1, wherein the first liquid guiding channel comprises a first liquid guiding groove, the first liquid guiding portion includes a first protruding portion and a second protruding portion arranged apart from each other, and the first protruding portion, the second protruding portion, the first surface of the bottom plate define the first liquid guiding groove.

5. The vaporizer of claim 4, wherein a surface of the first protruding portion close to the second protruding portion comprises an inner arc surface, and wherein a surface of the second protruding portion close to the first protruding portion comprises an outer arc surface.

6. The vaporizer of claim 5, wherein the first protruding portion comprises two arc protrusions, and the second protruding portion comprises an annular protrusion, wherein the two arc protrusions are oppositely arranged on two sides of the annular protrusion apart from the annular protrusion, one end of each arc protrusion abutting against an edge of the second liquid guiding portion, an other end of each arc protrusion extending in a direction away from the second liquid guiding portion, and wherein a relative distance between the two arc protrusions and the annular protrusion decreases gradually in a direction toward the second liquid guiding portion so as to cooperate with the first surface of the bottom plate to form two first liquid guiding grooves.

7. The vaporizer of claim 6, wherein the two arc protrusions are on a same circular arc, and wherein the circular arc on which the two arc protrusions are arranged is arranged eccentrically with an annular arc on which the annular protrusion is arranged.

8. The vaporizer of claim 6, wherein the annular protrusion is circular and a surface of the annular protrusion close to the second liquid guiding portion has a tangent plane, and wherein a vertical distance between the tangent plane and the second liquid guiding portion is smaller than a horizontal size of a part of the first guide channel close to the second liquid guiding portion.

9. The vaporizer of claim 6, wherein the annular protrusion abuts against the second liquid guiding portion to form two independent first liquid guiding channels, and wherein each first liquid guiding channel is in communication with at least two second liquid guiding channels.

10. The vaporizer of claim 6, wherein the liquid guiding assembly further comprises a baffle, wherein the annular protrusion is arranged apart from the second liquid guiding portion, wherein the baffle is arranged between the annular protrusion and the second liquid guiding portion to form two independent first liquid guiding channels, and wherein each first liquid guiding channel is in communication with at least the two second liquid guiding channels.

11. The vaporizer of claim 6, wherein the annular protrusion comprises an electrode ejector pin mounting base.

12. The vaporizer of claim 1, wherein the second liquid guiding channel extends from an end portion of the second liquid guiding portion to the first surface of the bottom plate, and wherein a horizontal size of the second liquid guiding channel is smaller than a horizontal size of one end of the first liquid guiding channel close to the second liquid guiding portion.

13. The vaporizer of claim 12, wherein the second liquid guiding portion comprises a porous material, and wherein micropores of the second liquid guiding portion form the second liquid guiding channel.

14. The vaporizer of claim 12, wherein the second liquid guiding channel comprises a liquid guiding hole formed on the second liquid guiding portion.

15. The vaporizer of claim 12, wherein the second liquid guiding channel comprises a second liquid guiding groove formed on the second liquid guiding portion, and wherein an opening of the second liquid guiding groove faces the first liquid guiding channel.

16. The vaporizer of claim 1, wherein the liquid guiding assembly further comprises a third liquid guiding portion arranged on the side wall of the second liquid guiding portion, wherein a third liquid guiding channel is formed on the third liquid guiding portion, one end of the third liquid guiding channel being in communication with the second liquid guiding channel, and wherein a capillary force of the third liquid guiding channel is greater than the capillary force of the second liquid guiding channel such that liquid absorbed by the first liquid guiding portion by the capillary force of the first liquid guiding channel is guidable to the third liquid guiding portion.

17. The vaporizer of claim 16, wherein an other end of the third liquid guiding channel is in communication with the vaporization core, and wherein the capillary force of the third liquid guiding channel is smaller than a capillary force of the vaporization core so as to guide liquid on the bottom plate to the vaporization core through the first liquid guiding channel, the second liquid guiding channel, and the third liquid guiding channel.

18. The vaporizer of claim 16, wherein the liquid guiding assembly further comprises a fourth liquid guiding portion, wherein the fourth liquid guiding portion and the second liquid guiding portion are arranged oppositely on two sides of the first liquid guiding portion, wherein the fourth liquid guiding portion has a fourth liquid guiding channel, and wherein one end of the fourth liquid guiding channel is in communication with the first surface of the bottom plate to guide liquid on the bottom plate to the fourth liquid guiding portion.

19. The vaporizer of claim 18, wherein an other end of the fourth liquid guiding channel is in communication with the vaporization core to guide liquid on the bottom plate to the vaporization core.

20. The vaporizer of claim 19, wherein a structure of the fourth liquid guiding portion is the same as a structure of the second liquid guiding portion.

21. The vaporizer of claim 20, wherein the liquid guiding assembly further comprises a fifth liquid guiding portion arranged between the second liquid guiding portion and the fourth liquid guiding portion and coopering with the first surface of the bottom plate to form at least one fifth liquid guiding channel, wherein the end of the fourth liquid guiding channel is in communication with the fifth liquid guiding channel so as to be in communication with the first surface of the bottom plate, and wherein a capillary force of the fourth liquid guiding channel is greater than a capillary force of the fifth liquid guiding channel so as to guide liquid absorbed by the fifth liquid guiding portion by the capillary force of the fifth liquid guiding channel to the fourth liquid guiding portion.

22. The vaporizer of claim 21, wherein a structure of the fifth liquid guiding portion is the same as a structure of the first liquid guiding portion.

23. The vaporizer of claim 22, wherein several air inlet holes are formed on the bottom plate, wherein the first liquid guiding portion and the fifth liquid guiding portion are symmetrically arranged on two sides of the air inlet holes, and wherein the second liquid guiding portion and the fourth liquid guiding portion are symmetrically arranged on the two sides of the air inlet holes.

24. An electronic vaporization device, comprising:

the vaporizer of claim 1, the vaporizer being configured to heat and vaporize liquid when energized; and a power supply component connected with the vaporizer and configured to supply power to the vaporizer.

* * * * *